United States Patent [19]

Kompanek

[11] Patent Number: 5,020,035

[45] Date of Patent: May 28, 1991

[54] TRANSDUCER ASSEMBLIES

[75] Inventor: Harry W. Kompanek, Santa Barbara, Calif.

[73] Assignee: Undersea Transducer Technology, Inc., Ventura, Calif.

[21] Appl. No.: 331,256

[22] Filed: Mar. 30, 1989

[51] Int. Cl.[5] ..... H04R 17/00

[52] U.S. Cl. ..... 367/159; 367/162; 310/321

[58] Field of Search ..... 310/337, 321, 369; 367/152, 157, 159, 162, 165, 176

[56] References Cited

U.S. PATENT DOCUMENTS

| | | | |
|---|---|---|---|
| 2,870,521 | 1/1959 | Rudnick | 310/369 X |
| 2,928,069 | 3/1960 | Petermann | 367/159 |
| 4,220,887 | 9/1980 | Kompanek | 310/369 X |
| 4,236,235 | 11/1980 | Gilbert | 367/157 |
| 4,446,544 | 5/1984 | Connolly, Jr. | 367/155 |
| 4,604,542 | 8/1986 | Thompson | 310/369 |
| 4,651,044 | 3/1987 | Kompanek | 310/369 |
| 4,774,427 | 9/1988 | Plambeck | 310/369 |
| 4,809,244 | 2/1989 | Penneck et al. | 367/162 |
| 4,823,041 | 4/1989 | Inoue et al. | 310/337 |

*Primary Examiner*—Brian S. Steinberger

*Attorney, Agent, or Firm*—Ellsworth R. Roston; Charles H. Schwartz

[57] ABSTRACT

A transducer assembly includes a hollow support member disposed in a looped configuration and having an axial opening. A hollow transducer supported within the support member may be made from a piezoelectric material and may be provided with an axial opening corresponding to position to the axial opening in the support member. In one embodiment, the outer surface of the support member may be thinned at spaced positions as by sockets or spaced axial grooves extending partially through the support member. The support member may be thinned at strategic positions to control the vibrational frequency and the frequency bandwidth of the transducer assembly. The thinned portions of the support member may receive a compliant material such as urethane to smoothen the outer surface of the support member. In another embodiment, the hollow interior of the transducer assembly may be filled with a compliant material, such as urethane, which may be provided with air chambers. The compliant material causes the shape of the transducer assembly to be retained, particularly when end caps are disposed on the support member, and causes the vibrations to be damped and the bandwidth of the vibrations to be increased. The air chambers produce a mismatch between the impedances inside and outside the transducer assembly and facilitate the transmission of substantially all of the vibrational energy outside of the assembly. In still other embodiments, members are included for bracing the support member and the transducer to increase the amplitudes of the assembly vibrations without damaging the transducer.

23 Claims, 3 Drawing Sheets

FIG. 1
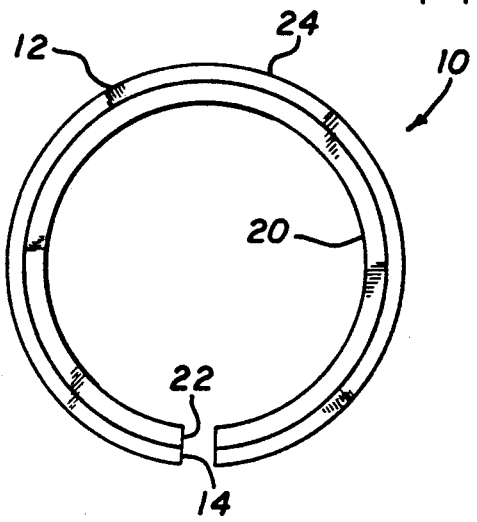
FIG. 2
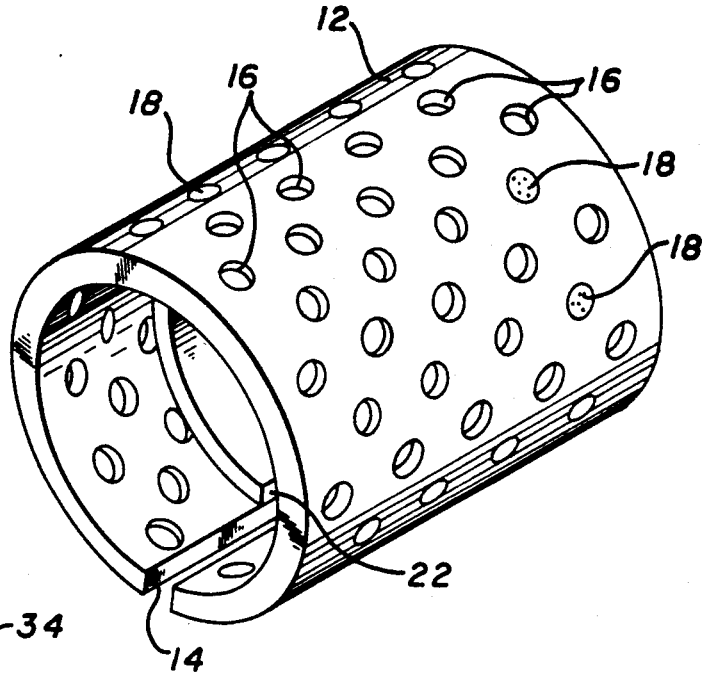
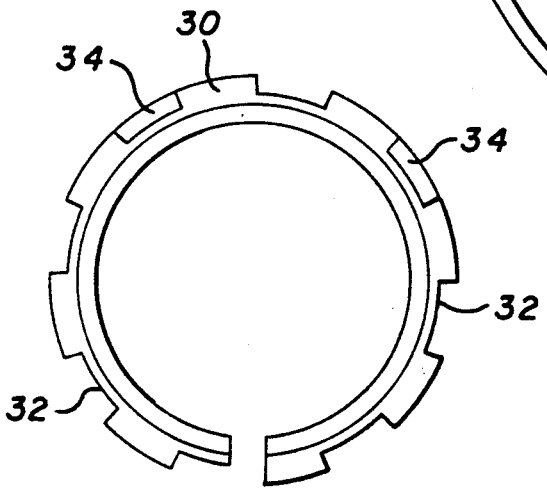
FIG. 3
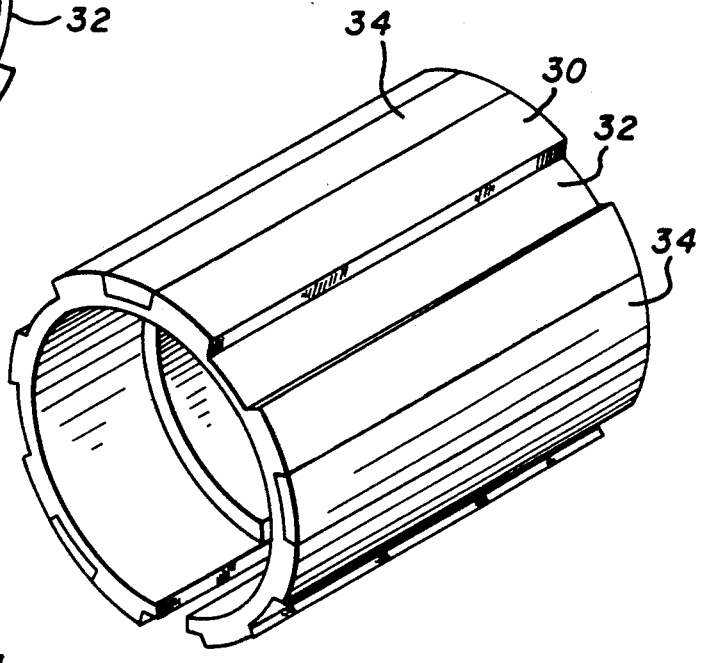
FIG. 4

FIG. 5
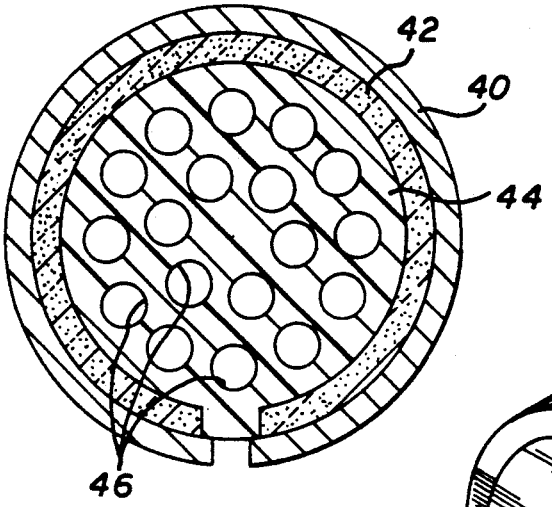
FIG. 6
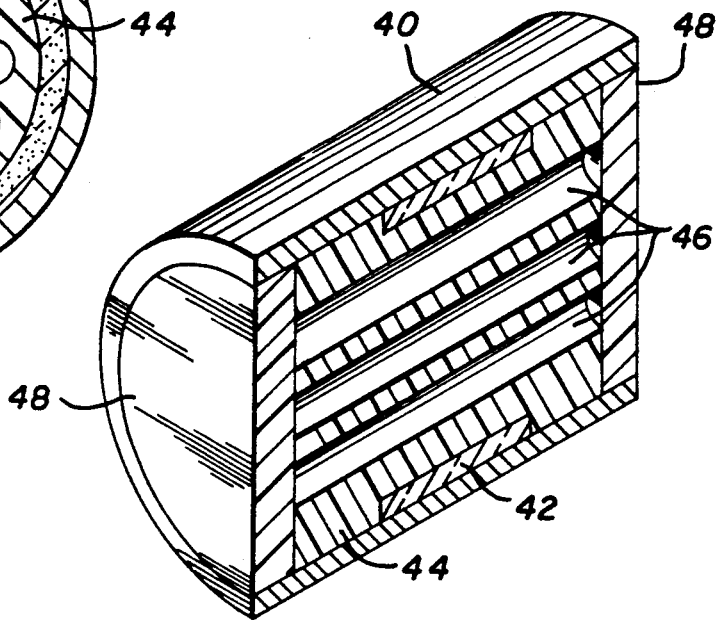
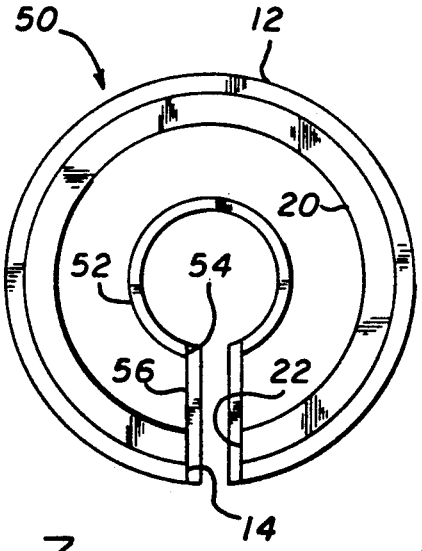
FIG. 7
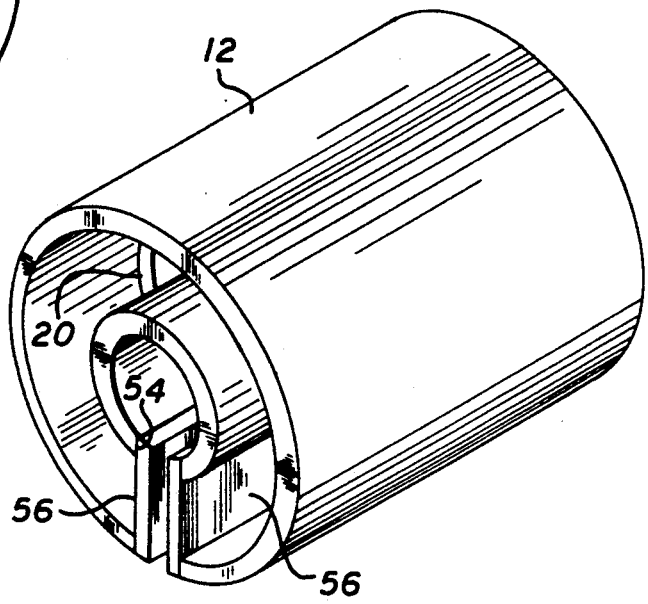
FIG. 8

FIG. 9
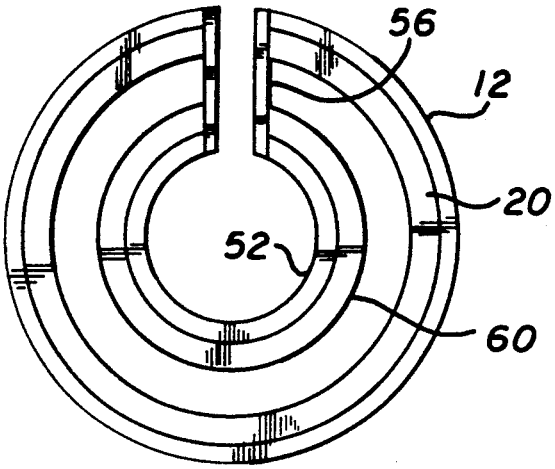
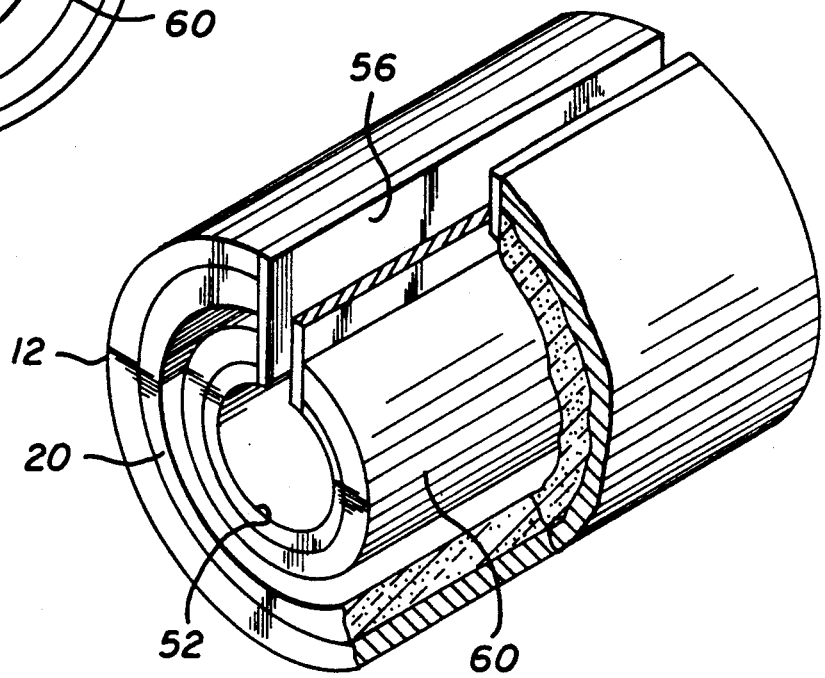
FIG. 10
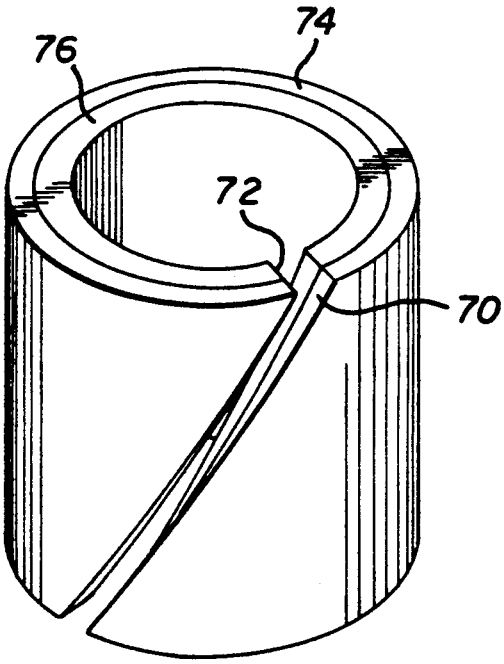
FIG. 11

TRANSDUCER ASSEMBLIES

This invention relates to transducer assemblies and more particularly relates to transducer assemblies for producing a vibration of a piezoelectric transducer when voltages are applied to the transducer. The invention is particularly concerned with transducer assemblies which can vibrate at controlled frequencies in an efficient manner to provide vibrations of high amplitudes without damaging any of the members in such assemblies.

Transducer assemblies including piezoelectric transducers are known in the prior art. In one particular type of such transducer assembly, a hollow support member made from a suitable material such as a metal is disposed in a looped configuration and is provided with an axial opening. A hollow transducer made from a suitable material such as a piezoelectric material is supported within the support member and is provided with an axial opening corresponding substantially in position to the axial opening in the support member. When a voltage is applied to the transducer, the transducer vibrates and sends signals into the medium enveloping the transducer assembly.

The transducer assemblies described in the previous paragraph have a number of different uses. For example, the transducer assemblies may be used in sonobuoys which are disposed in the ocean to detect underwater sounds. The transducer assemblies may be also included in oil well equipment to facilitate the recovery of oil from the earth.

Regardless of the use which is made of the transducer assemblies described in the previous paragraph, the transducer assemblies have certain inherent limitations. For example, the frequencies of the vibrations cannot be controlled as precisely as might be desired for some applications. The bandwidth of the vibration frequencies cannot be made as wide as might be desired for some applications. Furthermore, the amplitudes of the vibrations cannot be made as large as might be desired for some applications, particularly since the transducer tends to crack when the amplitude of the vibrations becomes excessive and uncontrolled. These limitations become especially troublesome when the transducer assemblies are used in certain applications such as for sonobuoys. These limitations have existed for some time even though considerable efforts have been made, and significant amounts of money have been expended, to overcome these limitations.

This invention provides transducer assemblies which overcome the limitations described in the previous paragraphs. The transducer assemblies include certain embodiments which control the operation of such assemblies to obtain a desired frequency and to increase the bandwidth of the vibrations in the assemblies. The transducer assemblies include second embodiments which also control the direction of the transmission of energy as a result of such vibrations so as to provide for the transmission of substantially all of such vibrational energy outwardly from the assemblies. The transducer assemblies also include third embodiments which include members for internally supporting the members in such assemblies so that the members can be vibrated at increased energies safely and reliably without cracking or otherwise damaging any of the members in such assemblies. In a further embodiment, the amplitudes of the vibrations in the transducer assemblies are singificantly enhanced.

In this invention, a transducer assembly provides a transducing action between a voltage applied to the assembly and vibrations in the assembly. The assembly includes a hollow support member disposed in a looped configuration and having an axial opening and also includes a hollow transducer supported within the support member. The transducer may be made from a piezoelectric material and may be provided with an axial opening corresponding in position to the axial opening in the support member.

In one embodiment, the outer surface of the support member may be thinned at spaced positions as by sockets extending at least partially through the support member or by the formation of spaced, axially extending grooves. The thinned portions of the support member may receive a compliant material such as urethane to smoothen the outer surface of the support member. The support member may be thinned at strategic positions to control the vibrational frequency and the frequency bandwidth of the transducer assembly.

In another embodiment, the hollow interior of the transducer assembly may be filled with a compliant material such as urethane and the compliant material may be provided with air chambers. End caps may be disposed on the support member. The compliant material causes the shape of the transducer assembly to be retained, particularly when the end caps are disposed on the support member, and causes the vibrations to be damped and the bandwidth of the vibrations to be increased. The air chambers produce a mismatch between the impedances inside and outside the transducer assembly and facilitate the transmission of substantially all of the vibrational energy outside of the assembly.

In still another embodiment, members are included for bracing the support member and the transducer to increase the amplitudes of the assembly vibrations without damaging the transducer. The members include a second support member disposed within the transducer in substantially concentric relationship with the first support member and also include rods extending between the first and second members to brace the members. A second transducer may be disposed on the second support member to form a second transducer assembly. Preferably the first and second transducer assemblies vibrate at substantially the same frequency so that the vibrations from the second assembly reinforce the vibrations from the first assembly.

In the drawings:

FIG. 1 is a sectional view of a transducer assembly constituting one embodiment of the invention;

FIG. 2 is an enlarged perspective view of a support member included in the embodiment shown in FIG. 1;

FIG. 3 is a sectional view, similar to that shown in FIG. 1, of a transducer assembly constituting a second embodiment of the invention;

FIG. 4 is a perspective view, similar to that shown in FIG. 2, of a support member included in the embodiment shown in FIG. 3;

FIG. 5 is a sectional view, similar to that shown in FIGS. 1 and 3, of a transducer assembly constituting a third embodiment of the invention;

FIG. 6 is a cut-away perspective view showing additional details in the construction of certain members included in the embodiment shown in FIG. 5;

FIG. 7 is a sectional view, similar to that shown in FIGS. 1, 3 and 5, of a transducer assembly constituting a fourth embodiment of the invention;

FIG. 8 is a perspective view, similar to that shown in FIGS. 2 and 4, showing additional features of the embodiment shown in FIG. 7;

FIG. 9 is a sectional view, similar to that shown in FIGS. 1, 3, 5 and 7, of a transducer assembly constituting a fifth embodiment of the invention;

FIG. 10 is a perspective view, similar to that shown in FIG. 8, showing additional features of the embodiment shown in FIG. 9; and FIG. 11 is a perspective view of a transducer assembly constituting a sixth embodiment of the invention.

In the embodiment of the invention shown in FIGS. 1 and 2, a transducer assembly generally indicated at 10 is provided. The transducer assembly 10 includes a hollow support member 12 made from a suitable material such as a metal. The metal may preferably be aluminum or steel. The support member is provided in a looped configuration, preferably annular, and is provided with an opening 14 which extends in an axial direction. The support member 12 may have a suitable thickness such as approximately one eighth of an inch (⅛") to one fourth of an inch (¼").

Sockets 16 are provided in the outer periphery of the support member 12. The sockets 16 preferably extend only partially through the thickness of the support member 12. In this way, the sockets 16 tend to make the support member 12 thinner at the positions of the sockets. The sockets 16 are shown in FIG. 2 as being disposed at spaced positions on the complete periphery of the support member 12. However, the sockets 16 can be disposed only at positions adjacent the opening 14 or only at positions diametrically opposite the opening 14 or at any other portion of the periphery surface of the support member 12.

The sockets 16 may be filled or partially filled with a suitable material 18. Preferably the material 18 is compliant and has a weight per unit of area less than that of the material of the support member 12. For example, the material 18 may be a urethane or a polyurethane. As will be appreciated, some, but not necessarily all, of the sockets 16 may be filled with the material 18.

A hollow transducer 20 is disposed within the support member 12 in an adhered relationship to the support member. The transducer 20 may be made from a suitable material such as a material having piezoelectric properties. For example, the g transducer 20 may be made from a suitable ceramic such as lead zirconium titanate. The transducer 20 may be bonded to the inner periphery of the support member by a suitable bonding agent. An axial opening 22 is provided in the transducer 20 at a position corresponding to the opening 14.

When the electrical signals are introduced to the transducer 20, the transducer vibrates. The maximum vibration occurs at the natural resonant frequency of the transducer 20. The amplitude of the vibrations increases progressively with progressive distances from the openings 14 and 22. Thus, the minimum amplitude of vibration occurs at a position 24 diametrically opposite the opening 14. However, the position 24 is where the maximum stress occurs in the piezoelectric transducer 20 because this is where the support member experiences the maximum amount of bending. When the vibrations become excessive, the transducer 20 may crack at the position 24. One of the functions of the support member 12 is to limit the amplitude of the vibrations of the transducer 20 so that the transducer does not become cracked.

The sockets 16 provide certain advantages when included on the periphery of the support member 12. They decrease the weight of the transducer assembly. They also tend to provide a controlled frequency for the transducer assembly 10. For example, when the sockets 16 are disposed in the area around the position 24 but not in the area adjacent the openings 14 and 22, the vibrational frequency of the transducer assembly 10 is decreased. This results from the fact that the decreased weight of the support member 12 at the position 24 relative to the weight of the support member at the positions adjacent the opening 14 increases the difficulty of the support member in vibrating. This reduction can be from a value of approximately five hundred hertz (500 Hz) to a value as low as approximately three hundred and fifty hertz (350 Hg).

Similarly, when the sockets 16 are provided in the support member 12 at the positions adjacent the opening 14 but not in the area adjacent the position 24, the vibrational frequency of the transducer assembly is increased. As will be appreciated, the vibrational frequency of the transducer assembly 10 is affected by the number of sockets 16 provided in the support member 12 and by the spacing between the sockets. The mechanical Q of the transducer assembly 10 can also be reduced by providing the sockets 16. When the mechanical Q is reduced, the bandwidth of the vibrational frequencies of the transducer assembly 10 is increased.

The inclusion of the material 18 in the sockets 16 provides certain additional advantages. For example, particularly when the material 18 is compliant, the vibrations of the transducer assembly 10 tend to become damped. This results in part from the fact that the mechanical Q tends to become reduced such as from a value of twenty (20) to a value as low as fourteen (14). The bandwidth of the vibrational frequency of the transducer assembly 10 also becomes increased.

The embodiment shown in FIGS. 3 and 4 has a construction corresponding in a number of respects to the g embodiment shown in FIGS. 1 and 2 and described above. However, instead of providing the sockets 16 in the support member, a support member 30 is provided with grooves 32 extending axially along the length of the support member. The grooves 32 may be filled with a material 34 such as urethane. The grooves 32 and the material 34 provide the same advantages as described above for the embodiment shown in FIGS. 1 and 2. This is even true with respect to the control of frequency since the relative disposition of the grooves 32 controls the vibrational frequency of the transducer assembly 10 in a manner similar to that described above.

The embodiment shown in FIGS. 5 and 6 includes a support member 40 and a transducer 42 corresponding in construction to the support member 12 and the transducer 20. Although the embodiment shown in FIGS. 5 and 6 does not specifically include the sockets 16 or the grooves 32, it will be appreciated that one or both of these features may be included in the embodiment shown in FIGS. 5 and 6.

The embodiment shown in FIGS. 5 and 6 includes a compliant material 44 such as urethane within the hollow interior of the transducer 42. The material 44 may be suitably bonded to the interior surface of the transducer 42. Air chambers or cavities 46 may be provided in the material 44 at spaced positions. The air chambers 46 preferably extend axially through the compliant material 44. End caps 48 made from a suitable material such as urethane plug the ends of the hollow interior of the transducer 42.

The apparatus described above and shown in the drawings has certain important advantages. It has an enhanced strength because the interior of the transducer 42 is filled by the material 44 and because the ends of the transducer are plugged by the end caps 48. The air chambers 46 are advantageous because they cause the transducer assembly to operate as if it is entirely filled with air. Furthermore, the air chambers 46 cause an impedance mismatch to be produced between the interior of the transducer 42 and the exterior of the support member 40. Because of such mismatch, substantially all of the energy produced by the vibrations of the transducer assembly is directed outwardly from the transducer assembly. This enhances the efficiency of operation of the transducer assembly. The compliant material 44 and the air chambers 46 also cause the mechanical Q of the transducer assembly to be reduced to a value as low as nine (9), thereby causing the bandwidth of the vibrational frequencies to be increased. Since the interior of the transducer 42 is sealed by the material 44 and the end caps 48, the transducer assembly can be exposed to sea water without any leakage of sea water into the transducer assembly.

The embodiment of FIGS. 7 and 8 shows a transducer assembly, generally indicated at 50, which includes the support member 12 and the transducer 20. The transducer assembly 50 also includes a second support member 52 which is disposed in concentric relationship with the support member 12 and the transducer 20. The support member 52 may be made from a suitable material such as a metal, steel or aluminum being illustrative.

The support member 52 has an opening 54 corresponding radially in position to the opening 12 in the support member 14 and the opening 22 in the transducer 20. Bracing members such as rods 56 are disposed at one end at positions adjacent the openings 14 and 22 and at the other end at a position adjacent the opening 54 and are attached to the support members 12 and 52 at the opposite ends.

The embodiment shown in FIGS. 7 and 8 has certain important advantages. As will be seen, the support member 52 reinforces the support member 12, particularly in view of the bracing action provided by the rods 56. This prevent the transducer 20 from cracking at its weak points. Because of this, the amplitudes of vibration in the transducer assembly 50 can be increased without damaging the transducer 20.

The embodiment shown in FIGS. 9 and 10 is substantially similar to the embodiment shown in FIGS. 7 and 8 except that it includes a second transducer 60 on the support member 52. The transducer 60 may be made from the same material as the transducer 20. The support member 52 and the transducer 60 accordingly act as a second transducer assembly.

Preferably the second transducer assembly vibrates at substantially the same frequency as the transducer assembly formed by the support member 12 and the transducer 20. This can be accomplished by carefully selecting the parameters of the support member 52 and the transducer 60. Since the two transducers vibrate at substantially the same frequency, the vibrations from one reinforce the vibrations from the other. As a result, the amplitudes of the vibrations from the transducer assembly formed by the support member 12 and the transducer 20 are significantly enhanced.

FIG. 11 illustrates a sixth embodiment of the invention. This embodiment is similar to the embodiment shown in FIGS. 1 and 2. However, openings 70 and 72 respectively provided in a support member 74 and a transducer 76 are disposed at an angle having components in the circumferential and axial directions. Preferably this angle is approximately 45° relative to the axial direction. The opening extends to the opposite axial ends of the support member 74 in a substantially linear direction displaced at one end circumferentially from the other axial end. Providing the openings 70 and 72 in a diagonal direction is advantageous because it tends to distribute the stress on the transducer 76 while maintaining the vibrations of the transducer assembly at substantially the same frequency as that produced by an axial opening. Furthermore, the diagonally disposed openings 70 and 72 allow the transducer 76 to be driven at an increased voltage, thereby providing for increased amplitudes in the vibrations in the transducer assembly.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination in a transducer assembly for providing a transducing action between a voltage applied to the transducer assembly and vibrations in the transducer assembly, a support member disposed in a looped configuration and having an opening and having external and internal peripheries, and a transducer supported within the support member and made from a piezoelectric material and having an opening corresponding in position to the axial opening in the support member, The support member being continuous in its internal periphery and being provided with thinner dimensions at particular positions in the external periphery of the support member to reduce the weight of the support member and to control the frequency of vibrations on the transducer assembly, and a material lighter and more compliant than the support member and filling the thinner dimensions of the support member.

2. A combination as set forth in claim 1 wherein the thinner dimensions of the support member are provided by sockets partially extending through the support member from the external periphery in a direction toward the transducer.

3. A combination as set forth in claim 1 wherein the thinner dimensions of the support member are provided by axial grooves partially extending through the support member from the external periphery in a direction toward the transducer.

4. A combination as set forth in claim 1 wherein the thinner dimensions are provided in the support member at positions extending from the external periphery in the support member near the opening in the support member to increase the frequency of the vibrations of the transducer assembly.

5. A combination as set forth in claim 1 wherein the thinner dimensions are provided in the support member at positions extending from the external periphery in the support member to decrease the frequency of the vibrations of the transducer assembly.

6. A combination as set forth in claim 1 wherein the light and compliant material filling the thinner dimensions of the support member is selected from the group consisting of a urethane or a polyurethane.

7. A combination as set forth in claim 1 wherein the thinner dimensions of the support member are provided by axial grooves partially extending through the support member from the external periphery of the support member in a direction toward the transducer and are disposed at particular positions in the annular direction to provide the transducer assembly with a particular frequency of vibration.

8. A combination as set forth in claim 1 wherein the thinner dimensions of the support member are provided by sockets partially extending through the support member from the external periphery of the support member in a direction toward the transducer and are disposed at particular positions in the annular direction to provide the transducer assembly with a particular frequency of vibration.

9. In combination in a transducer assembly for providing a transducing action between a voltage applied to the transducer assembly and vibrations in the transducer assembly, a hollow support member disposed in a looped configuration and having external and internal peripheries and an opening, a hollow transducer support within the support member on the internal periphery of the support member and made from a piezoelectric material and having an opening corresponding in position to the opening in the support member and constructed to produce vibrations upon receiving electrical energy, and a compliant material disposed within the hollow transducer and having a plurality of air chambers disposed at selected positions in the compliant material to provide a mismatch between the impedance within the support member and the impedance outside the support member for providing for the transmission externally of the support member of substantially all of the energy of the vibrations in the hollow transducer.

10. A combination as set forth in claim 9, including, caps disposed on the ends of the transducer.

11. A combination as set forth in claim 9 wherein the air chambers extend axially through the space within the hollow transducer.

12. In a combination as set forth in claim 11 wherein the compliant material is provided with properties to damp the vibrations of the support member and increase the bandwidth of such vibrations.

13. In a combination as set forth in claim 9 wherein the compliant material substantially fills the hollow space within the transducer and the air chambers extend axially within this hollow space and the compliant material is constructed to damp the vibrations of the support member and increases the bandwidth of such vibrations.

14. In a combination in a transducer assembly for providing a transducing action between a voltage applied to the transducer assembly and vibrations in the transducer, an annular support member having a hollow configuration and an opening and having external and internal peripheries, an annular transducer disposed within the support member on the internal periphery of the support member and having a hollow configuration and an opening at substantially the position of the opening in the support member and made from a piezoelectric material, a compliant material disposed within the hollow interior of the transducer and substantially filling the hollow interior of the transducer and having air chambers at spaced positions to increase the frequency bandwidth of the vibrations in the transducer, and end caps disposed on the ends of the annular transducer to seal the transducer assembly.

15. A combination as set forth in claim 14 wherein the air chambers are disposed within the hollow interior of the chamber to provide a mismatch between the impedance inside the transducer and the impedance outside the transducer to facilitate the transmission of energy outside of the transducer.

16. A combination as set forth in claim 14 wherein the air chambers extend axially through the compliant material at spaced radial and annular positions in the compliant material.

17. A combination as set forth in claim 16 wherein the air chambers extend axially through the compliant material in substantially equally spaced relationship to one another.

18. In combination in a transducer assembly for providing a transducing action between a voltage applied to the transducer assembly and vibrations in the transducer assembly, a hollow support member disposed in a looped configuration and having an opening, a hollow transducer supported within the support member and made from a piezoelectric material and having an opening corresponding in position to the opening in the support member, and means disposed within the transducer and coupled mechanically to the support member to brace the support member and enhance the amplitude of the vibrations in the support member and the transducer without any damage to the transducer, the bracing means including a second support member disposed within the hollow transducer and further including means extending between the first and second support members to cooperate with the second support member in bracing the first support member, the second support member being annular and being concentric with the first support member and the means extending between the first and second support members including rods disposed between, and attached to, the first and second support members.

19. In combination in a transducer assembly for providing a transducing action between a voltage applied to the transducer assembly and vibrations in the transducer assembly, a hollow support member disposed in a looped configuration and having an opening, a hollow transducer supported within the support member and made from a piezoelectric material and having an opening corresponding in position to the opening in the support member, and means disposed within the transducer and coupled mechanically to the support member to brace the support member and enhance the amplitude of the vibrations in the support member and the transducer without any damage to the transducer, the bracing means including a second support member disposed within the hollow transducer and further including means extending between the first and second support members to cooperate with the second support member in bracing the first support member, the second support member being annular and concentric with the first support member and the means extending between the first and second support members including rods disposed between, and attached to, the first and second support members, the second support member having an axial opening at a position aligned substantially radially with the axial opening the first support member and the rids extending in substantially parallel relationship between positions adjacent the axial opening sin the first and second support members.

20. In combination in a transducer assembly for providing a transducing action between a voltage applied to the transducer assembly and vibrations in the transducer assembly, a support member disposed in a looped configuration and having an opening and having external and internal peripheries, a transducer disposed in a looped configuration and supported within the support member on the internal periphery of the support member and made from a piezoelectric material and having an opening corresponding in position to the position of the opening in the support member, and means disposed within the hollow transducer and providing a bracing action for the support member and the transducer and vibratible at substantially the same frequency as the support member and the transducer to reinforce the vibrations of the support member and the transducer.

21. A combination as set forth in claim 20 wherein the bracing means includes a second support member having external and internal peripheries and disposed within the hollow transducer in substantially concentric relationship with the first support member and the hollow transducer and further includes a second transducer disposed within the second support member on the internal periphery of the second support member and made from a piezoelectric material.

22. In combination in a transducer assembly for providing a transducing action between a voltage applied to the transducer assembly and vibrations in the transducer assembly, a support member disposed in a looped configuration and having an opening, a transducer supported within the support member and made from a piezoelectric material and having an opening corresponding in position to the opening in the support member, and means disposed within the hollow transducer and providing a bracing action for the support member and the transducer and vibratible at substantially the same frequency as the support member and the transducer to reinforce the vibrations of the support member and the transducer, the bracing means including a second support member disposed within the hollow transducer in substantially concentric relationship with the first support member and the hollow transducer and further including a second transducer disposed on the second support member and made from a piezoelectric material, the second support member and the second transducer having openings substantially aligned radially with the openings in the first support member and the first transducer.

23. A combination as set forth in claim 22 wherein the bracing means includes rods extending between the first and second support members at positions adjacent the openings in the support members.

* * * * *